United States Patent [19]

Young et al.

[11] Patent Number: 4,688,684

[45] Date of Patent: Aug. 25, 1987

[54] VERTICAL DISPLAY SYSTEM

[75] Inventors: Raymond R. Young, Glenview; John F. Deffner, Lisle; Russell M. Barnes, Bloomingdale, all of Ill.

[73] Assignee: Visual Marketing Inc., Chicago, Ill.

[21] Appl. No.: 816,813

[22] Filed: Jan. 7, 1986

[51] Int. Cl.[4] ..... A47F 7/00

[52] U.S. Cl. ..... 211/59.4; 211/74; 211/77; 108/106; 108/151

[58] Field of Search ..... 211/59.3, 59.4, 74, 211/77, 131, 133, 194, 205; 206/45.14, 45.15, 45.16; 108/106, 107, 110, 151; 248/188.2; 40/606, 607, 479

[56] References Cited

U.S. PATENT DOCUMENTS

| | | | |
|---|---|---|---|
| 446,472 | 2/1891 | Roberts | 108/106 |
| 1,339,525 | 5/1920 | Rod . | |
| 1,358,792 | 11/1920 | Shogran | 108/106 |
| 1,703,340 | 2/1929 | Grennan | 108/107 |
| 1,735,051 | 11/1929 | Moe | 211/77 |
| 1,915,727 | 6/1933 | Friedemann . | |
| 2,155,097 | 4/1939 | Mendle . | |
| 2,290,410 | 7/1942 | Dawson . | |
| 2,689,050 | 9/1954 | Albin | 211/128 |
| 2,946,456 | 7/1960 | Liguori | 211/77 |
| 3,119,588 | 1/1964 | Keats . | |
| 3,194,403 | 7/1965 | Van Horn, Jr. . | |
| 3,245,365 | 4/1966 | Doherty | 108/144 |
| 3,692,188 | 9/1972 | Bayne | 211/49 D |
| 3,963,126 | 6/1976 | Taub | 211/131 |
| 4,010,698 | 3/1977 | Taub | 108/111 |
| 4,193,351 | 3/1980 | Belokin, Jr. | 108/59 |
| 4,262,439 | 4/1981 | Dinan et al. | 40/607 |
| 4,343,842 | 8/1982 | Chase | 211/205 |

FOREIGN PATENT DOCUMENTS

| | | | |
|---|---|---|---|
| 1547684 | 6/1979 | United Kingdom | 211/59.4 |

OTHER PUBLICATIONS

Advertisement of RTC Industries, Inc., showing various vertical display systems.

*Primary Examiner*—Cornelius J. Husar
*Assistant Examiner*—Anthony Knight
*Attorney, Agent, or Firm*—Willian Brinks Olds Hofer Gilson & Lione Ltd.

[57] ABSTRACT

A free-standing vertical display system for displaying merchandise, such as beverage containers, at the point of purchase, is described. The system includes a base and one or more trays which are slidably received on a center pole. In a first embodiment a merchandise-bearing tray rests on the merchandise on the tray beneath it. When the tray is empty, it may be stored on four screws protruding from the top of the center pole, allowing the customer to access the lower trays. A second embodiment of the invention provides a spring on the center pole, underneath each tray. When a tray is loaded with merchandise, the spring compresses and the tray rests on the merchandise on the tray beneath it. When a tray is emptied, the spring pushes the tray up, so that merchandise may be removed from the tray below. A third embodiment of the invention provides stationary spacer poles at the periphery of each tray to separate the trays, so that merchandise may be accessed from all trays simultaneously. All three embodiments of the invention can be provided with a cylindrical header positioned on top of the center pole and carrying product identification labels or other advertisements.

16 Claims, 12 Drawing Figures

FIG. 3
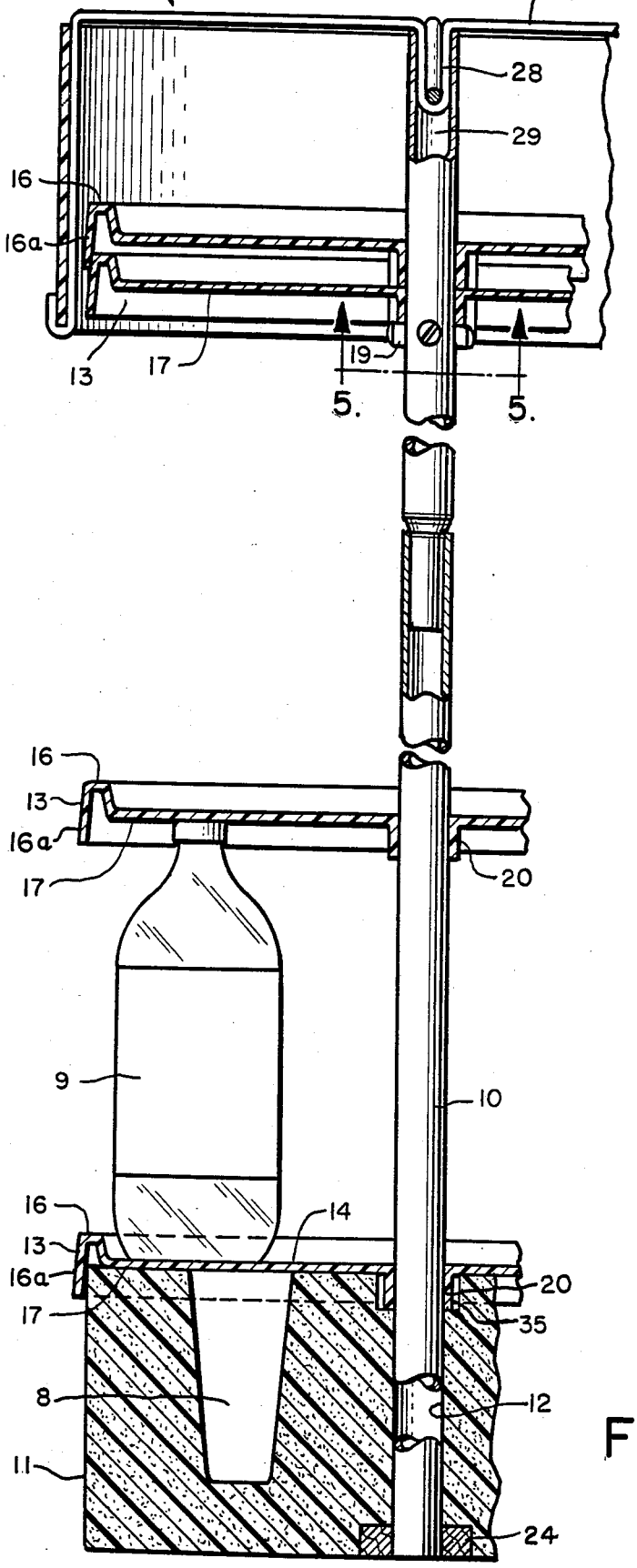
FIG. 5
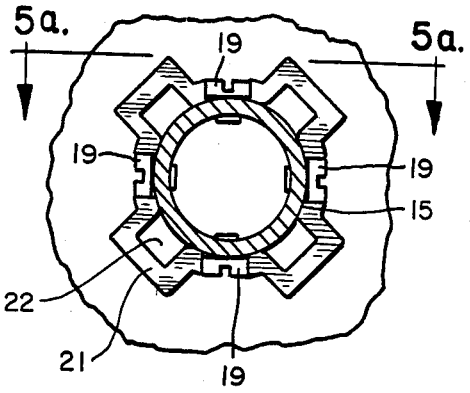
FIG. 5a
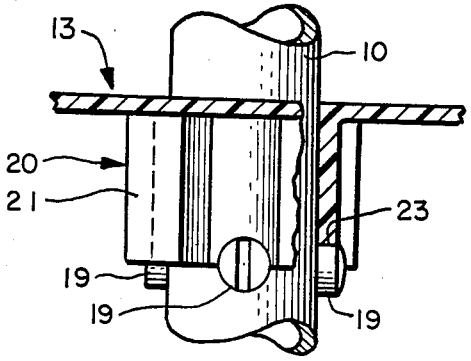
FIG. 5b
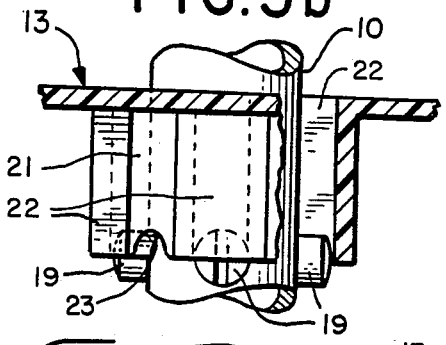
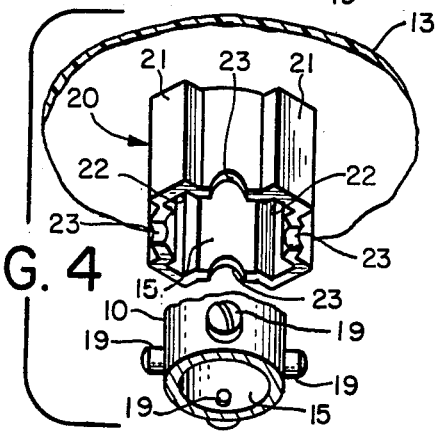
FIG. 4

FIG. 6
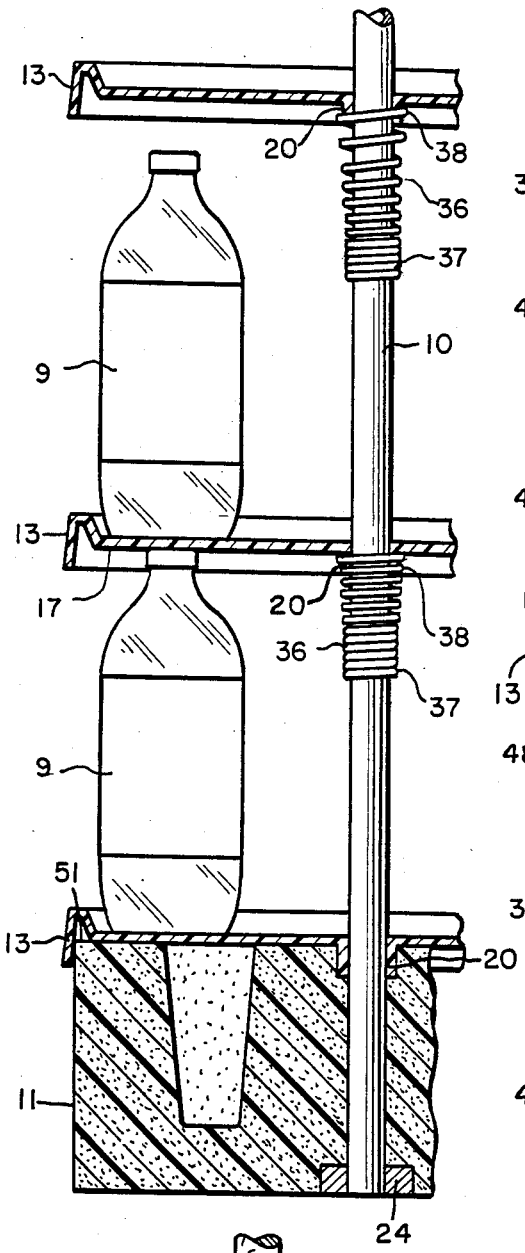
FIG. 7a
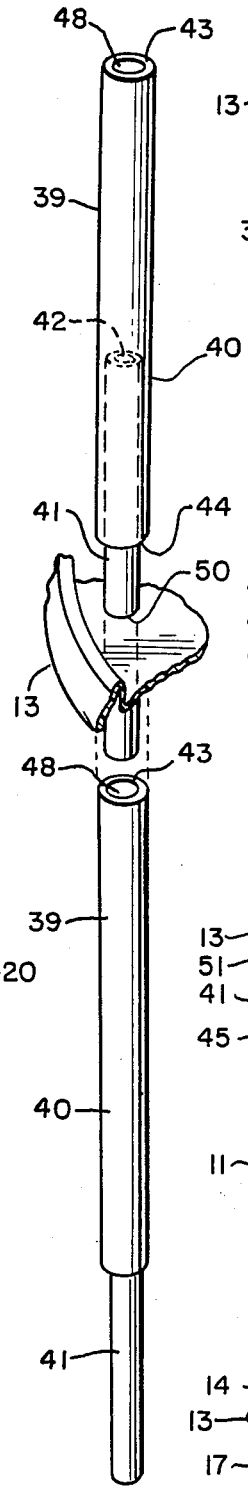
FIG. 7
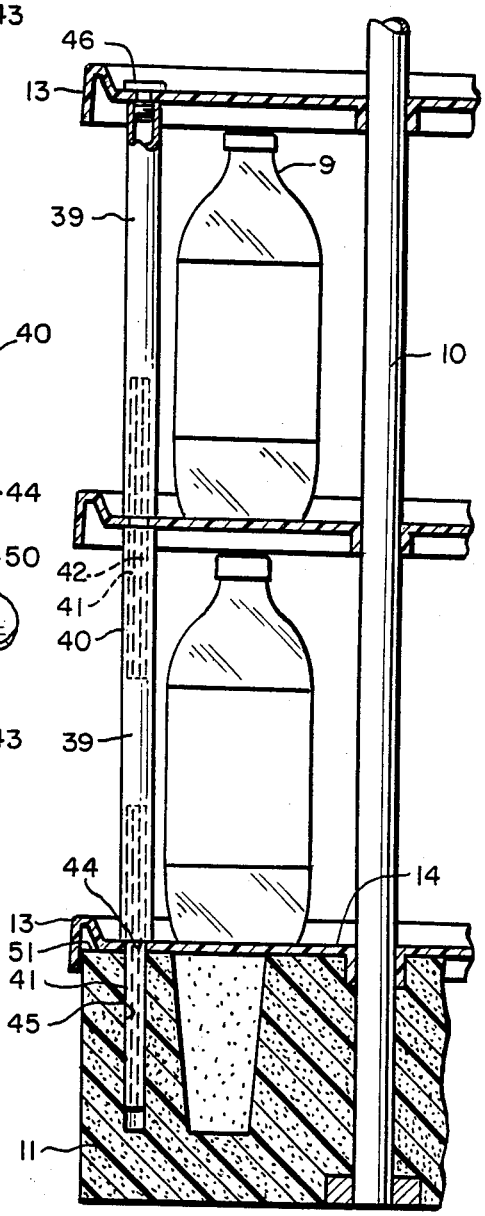
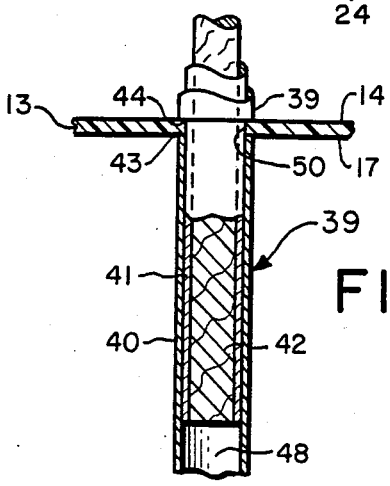
FIG. 8
FIG. 9
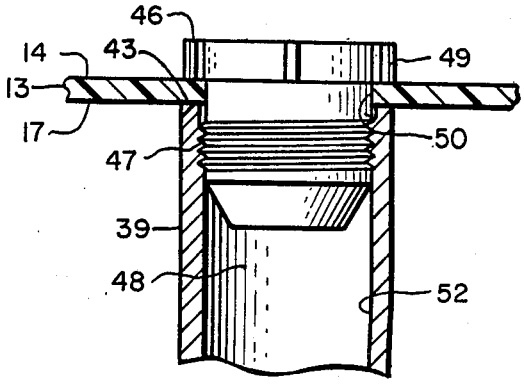

VERTICAL DISPLAY SYSTEM

BACKGROUND OF THE INVENTION

The present invention relates to systems and apparatus for displaying goods or articles to prospective purchasers in stores and shops.

Typically, retailers display articles or goods in long rows of shelves, making product differentiation difficult for customers. Shelf displays are often too high or too deep for customers to readily access the displayed product, particularly when a large inventory is being displayed. This problem has been addressed in the past by use of free-standing individual displays, which are set off from the rows of shelves to create a more prominent display of an individual product and permit the merchandiser to display a large inventory which is more easily accessible to customers than shelf displays.

Various free-standing, vertical display units are known. Some employ a plurality of vertical standards or tray spacers, between which trays are positioned, while others employ a single standard or center pole, around which a plurality of trays are placed. Each of these types of displays has its own advantages and disadvantages. For example, the center pole-type of display provides greater visibility for the product displayed than the type of display employing a plurality of spacer poles around the periphery of the storage trays. Some known center pole-type displays, however, have traditionally required complex construction to support substantial loads. Other center pole-type units permit trays to rest on top of merchandise beneath each tray, and therefore do not require such rigid construction. However, these units fail to provide convenient means for storing empty trays, and do not permit easy access to full trays beneath the empty top tray. An example of such device is shown in U.S. Pat. No. 4,193,351. Still other center pole-type units employ display trays which are fastened to the center pole. This type of display has the advantage of permitting easy access to goods stored on all trays, but requires the unit to be reassembled in order to vary heights between trays. Additionally, because the trays do not rest on the merchandise directly below, this type of unit is disadvantageous in that the trays and fastening means are limited in their ability to support substantial loads. An example of this type of unit is shown in U.S. Pat. No. 4,262,439.

Another type of known vertical display unit employs a plurality of supporting poles around the periphery of each stacked tray. The primary advantage of this type of unit is that merchandise can be readily accessed from all trays rather than only the top tray. This is a particularly important feature when different products or products of varying heights are to be displayed on the same unit. An additional advantage of these types of units is that the spacer poles permit the weight of the assembly to be isolated from the shelves, and transmitted by the spacer poles to the base. Examples of this type of unit are shown in U.S. Pat. No. 4,010,698 and U.S. Pat. No. 3,245,365. The disadvantages of these types of units are that they do not provide the same degree of product visibility as the center-pole type of display, since the peripheral poles tend to hide the displayed product. Additionally, these types of units have traditionally been cumbersome to assemble or disassemble requiring locking pins to position the trays on the spacer poles or washers to enhance the stability of the structure. A further disadvantage of the assembly shown in U.S. Pat. No. 4,010,698 is that the spacer poles are not all identically constructed, requiring production of different types of poles and limiting the versatility of the unit.

SUMMARY OF THE INVENTION

The present invention provides a vertical display system that overcomes many of the shortcomings of presently known systems. In one preferred embodiment, the invention employs a base supporting a vertical center pole, which slidably receives one or more trays. Each tray, when full, rests on the merchandise stored on the tray beneath it. When the top tray is empty, it is stored by sliding it to the top of the center pole, and resting it on a plurality of protruding members, such as screws, positioned near the top of the center pole. A plurality of grooves in each tray permit the tray to clear the screw as the tray is slid to the top of the pole. Once the tray clears the screws, it is rotated so that the screws interface with notched flanges on the underside of the tray, which support the empty tray and prevent the tray from sliding back down the center pole. The same procedure is followed as each successive tray is emptied, permitting up to three empty trays to be stored at the top of the display unit.

In another preferred embodiment of the invention, each tray is supported by a spring which is positioned coaxially on the center pole. When loaded, each tray rests on the merchandise directly beneath it, and the spring is compressed. When the top tray is emptied, the spring pushes the empty tray up the center pole so merchandise may be removed from the tray immediately below. As each successive tray is emptied, the spring beneath it likewise pushes the tray up the center pole, permitting customer access to merchandise stored below.

In another preferred embodiment of the invention, peripheral spacer poles are employed. A plurality of holes is provided in the periphery of each tray and in the base to accept a spacer pole consisting of telescoping sections. Each pole section has one end of a smaller diameter than the other end. The smaller diameter fits through the holes in the periphery of the tray and the base. The wider diameter end of the pole is larger than the diameter of the holes in the base and the trays. In use, the wider diameter end of the pole accepts the smaller diameter end of another pole, allowing trays to be vertically spaced. At the same time, the wider diameter of the pole supports the trays.

The same trays can be used in all of the above described preferred embodiments of the present invention. Thus, the display unit may be easily converted from the center-pole display system to a peripheral pole display system. In the peripheral pole embodiment, the center pole is preferably retained to provide additional structural support to the display unit. One or more of the preferred embodiments of the invention may be employed in a single display unit, for example, by utilizing the spacer poles to support the lowermost tray above the base, in combination with the spring means for the upper trays. In all three of the above-described preferred embodiments, a cylindrical header assembly displaying product identification labels or other advertisements may be positioned atop the center pole.

Accordingly, an advantage of the present invention is that it combines features of ease of assembly, versatility, and durability in an attractive display requiring a minimum of pieces and no tools for assembly.

Another advantage of the present invention is that it utilizes lightweight, inexpensive materials of construction, allowing the assembled display unit to be easily moved.

Another advantage of the present invention is that it permits customers to easily access merchandise stored on the display unit.

Yet another advantage of the present invention is that it permits merchandise of different heights and merchandise produced by different manufacturers to be displayed in the same unit.

Still another advantage of the present invention is that it is easily converted to any one of three preferred embodiments.

Another advantage of the present invention is that more than one of the preferred embodiments may in combination be used in one display unit.

The invention itself, with further objects and attendant advantages, will best be understood by reference to the following detailed description taken in conjunction with the drawings.

BRIEF DESCRIPTION OF THE DRAWINGS

FIG. 3 is a partial cross-sectional side view of a preferred embodiment of the present invention with parts broken away to show various details.

FIG. 4 is a perspective view of a portion of a preferred embodiment of the present invention with parts broken away to show various details.

FIG. 5 is a cross-sectional view taken along lines 5—5 of FIG. 3.

FIG. 5*a* is a sectional view taken along lines 5*a*—5*a* of FIG. 5.

FIG. 5*b* is a view of a portion of a preferred embodiment of the present invention of FIG. 5 taken along lines 5*a*—5*a* with parts partially rotated and broken away to show various details.

FIG. 6 is a side elevation view in partial cross-section of a portion of a preferred embodiment of the present invention.

FIG. 7 is a side elevation view in partial cross-section of a portion of a preferred embodiment of the present invention with hidden parts shown in phantom lines.

FIG. 7*a* is an exploded perspective view of a portion of the preferred embodiment of FIG. 7 with hidden parts shown in phantom lines.

FIG. 8 is a cross-sectional view of a portion of the preferred embodiment of FIG. 7 with parts broken away to show various details.

FIG. 9 is a cross-sectional view of a portion of the preferred embodiment of FIG. 7.

DETAILED DESCRIPTION OF PREFERRED EMBODIMENTS OF THE INVENTION

Figure 1:
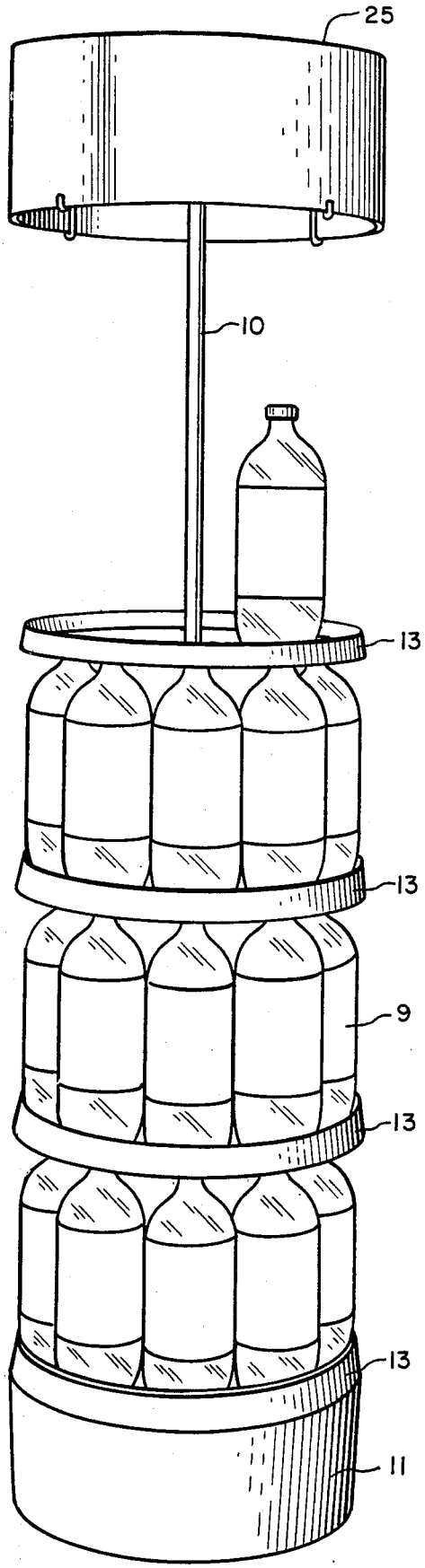
FIG. 1 is a perspective view of a preferred embodiment of the present invention.

Referring now to the drawings, FIGS. 1–9 show preferred embodiments of the present invention.

Figure 2:
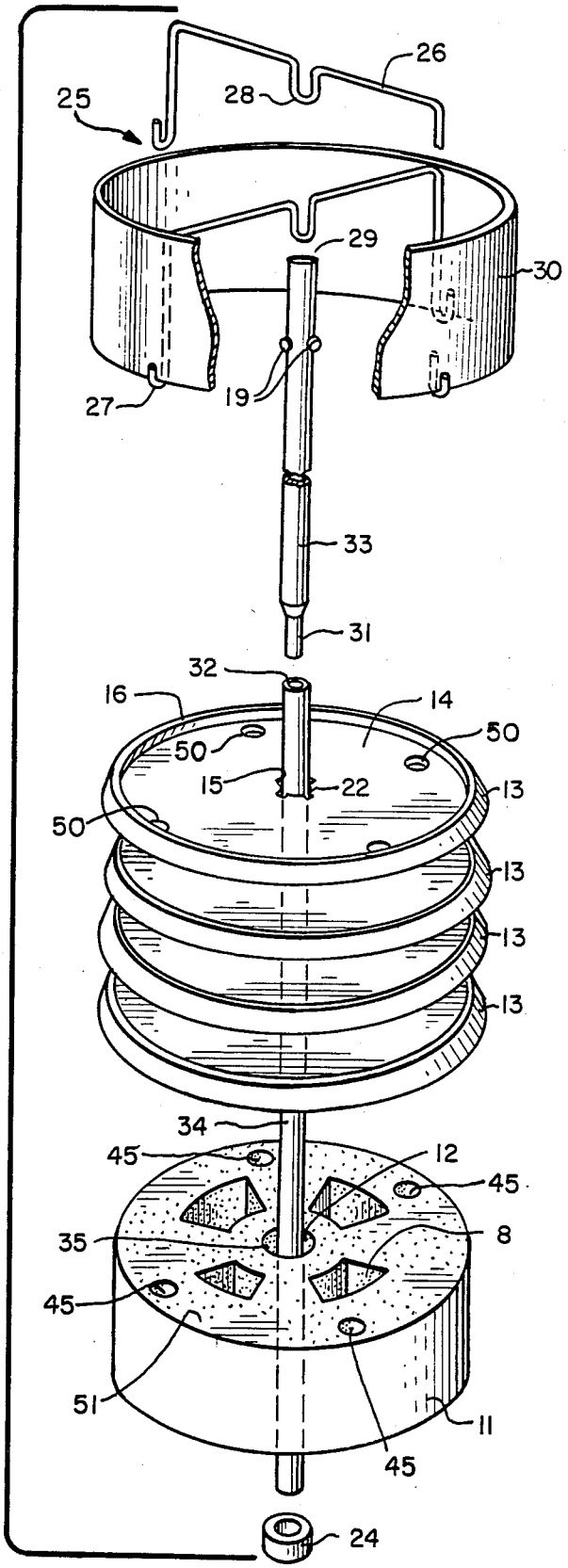
FIG. 2 is an exploded view of a preferred embodiment of the present invention with parts broken away to show various details.

As shown in FIGS. 1–3, a preferred embodiment of the present invention includes a base 11 having an upper surface 51 and a vertical opening 12 preferably positioned in the center of the base. The base 11 is preferably constructed of a strong, lightweight material such as expanded polystyrene (STYROFOAM), and may include hollow sections 8 to minimize the weight of the base. The opening 12 in the base 11 is sized to slidably but snugly receive a center pole 10. As shown in FIGS. 2 and 3, the center pole 10 may be constructed in sections. As shown in FIG. 2, the center pole 10 has an upper pole section 33 and a lower pole section 34. The upper pole section 33 has a tapered end 31 which is inserted into an opening 32 in the lower pole section 34, forming the center pole 10. The center pole 10 is preferably constructed of a strong durable material, such as seamless steel tubing.

For added support of the center pole 10, the base 11 may also include a reinforcing disc 24 journaled into the center of the base, as shown in FIGS. 2–3. The reinforcing disc 24 is preferably constructed of a hard durable material such as hardwood.

In use, the base-supported center pole 10 slidably receives a plurality of trays 13 which support articles 9 being displayed. The trays 13 are identically constructed, preferably of a strong, lightweight material such as high impact polystyrene. Each tray 13 includes a center opening 15 which is sized to enable the trays to be easily slid onto the center pole 10. Each tray includes an article supporting surface 14 on which articles 9 are displayed. In use, the lowest tray 13 preferably rest on the upper surface 51 of the base 11 as shown in FIGS. 1 and 3. Articles 9 are then placed on this lowest tray 13 until the tray is full. A second tray is then placed directly on top of the articles 9 displayed on the lowest tray 13, so that the tops of the articles provide support for the tray immediately above. As shown in FIG. 3, each tray 13 has a lower surface 17 which allows the tray to rest on articles 9 stored on the tray below. Articles are then placed on this second tray until the tray is full. This procedure is followed for additional trays positioned on the display system, as shown in FIGS. 1–3. Each of the trays 13 preferably includes a retaining wall 16, which prevents articles 9 from sliding off of tray 13. A shown in FIG. 3, this retaining wall 16 preferably includes a skirt portion 16a which preferably extends below the lower surface 17 of the tray 13. This skirt portion 16*a*, in conjunction with the lower surface 17, performs multiple functions of maintaining the position of the lowermost tray on the base 11, assisting in retaining the articles 9 on the trays, and allowing the trays to be stacked one atop the other when empty, as shown in FIG. 3.

Th embodiment shown in FIGS. 1–5 permits empty trays 13 to be stored near the top of the display system, as shown in FIG. 3. As shown in FIGS. 2–5, empty trays are stored on a plurality of equally-spaced protruding members, such as screws or pins 19. As shown in FIGS. 3 and 4, screws 19 are used, and the screws 19 are inserted horizontally into the center pole 10 near the top of the center pole such that the heads of the screws 19 project outwardly from the center pole 10. Preferably, four screws 19 are used, as shown in FIG. 4, although as few as two or three screws could be used, and more than four screws could also be used.

As shown in FIG. 4, each tray 13 includes a guide unit 20 which includes a guide sleeve 21 having a plurality of equally-spaced vertical grooves 22, the vertical grooves 22 being equal in number to the screws 19 being used. The guide unit 20 is positioned on the underside of the tray 13 and is contiguous with the center opening 15 of the tray. The guide unit 20 also includes a plurality of equally-spaced notches 23. The notches 23 are alternately positioned on the guide unit 20 between the vertical grooves 22 as shown in FIG. 4, and are equal in number to the number of screws 19 and vertical grooves 22 being used. As shown in FIGS. 4, 5, 5*a* and 5*b*, the screws 19, the notches 23, and the vertical grooves 22 are spaced such that the screws 19 may be aligned with either the vertical grooves 22 or the notches 23 by rotating the tray 13 on the center pole 10.

The guide unit 20 allows an empty tray to be stored on screws 19. To store an empty tray, the tray 13 is slid up the center pole past the screws 19 by aligning the vertical grooves 22 in the tray 13 with the screws 19 as shown in FIG. 5*b*. The vertical grooves 22 are sized to permit the tray 13 to clear the screws 19 as the tray is slid up the center pole 10. Once the tray 13 is slid past the screws 19, the tray is stored on the screws 19 by rotating the tray such that the notches 23 align with the screws, and lowering the tray 13 onto the screws 19. The notches 23 in the guide unit 20 rest on the screws 19, allowing the stored tray 13 to be locked into place on the center pole 10 as shown in FIGS. 3, 5, and 5*a*. Additional trays may be stored by repeating this procedure, stacking the trays one on top of the other and locking the lowermost stored tray 13 on the screws 19 as shown in FIG. 3. The stored tray(s) may be slid back down the center pole 10 by lifting the tray 13, rotating it such that the vertical grooves 22 are aligned with the screws 19, as shown in FIG. 5*b*, and sliding the tray 13 past the screws 19 down the center pole 10.

The opening 12 in the base 11 is preferably countersunk with a larger diameter opening 35, as shown in FIG. 3 in order to allow the guide unit 20 to be received by the base 11 so the lowermost tray 13 rests flatly on the base 11.

As shown in FIGS. 1–3, the present invention may also include a header assembly 25. The header assembly includes a pair of header wires 26 and a header panel 30. The header wires 26 include a looped portion 28 which allows the header wires 26 to be secured at the top of the center pole 10 by inserting the looped portion 28 into the opening 29 at the upper end of the center pole 10, as shown in FIG. 3. Preferably, the header wires 26 are positioned at 90 degree angles to one another. The header wires 26 also include hooked portions 27 which support the header panel 30, as shown in FIG. 2. In use, the header panel 30 contains product identification labels or other advertising messages.

Another preferred embodiment of the present invention is shown in FIG. 6. This embodiment includes the use of springs 36 attached to the center pole 10, which automatically raise empty trays 13 on the center pole 10. In this way, articles 9 can be easily accessed from the tray directly below the empty tray. In use, the springs 36 are generally tapered, having a narrow diameter end 37 and a wider diameter end 38. The springs 36 are preferably constructed of galvanized wire. Preferably, the narrow diameter end is tightly wound and sized to enable the spring 36 to be frictionally engaged on the center pole 10 at any desired location. Typically, the spring 36 is placed coaxially on the center pole 10 with the narrow diameter end 37 below the wider diameter end 38. The spring is placed at a predetermined position on the center pole 10, and a tray 13 is slid onto the center pole 10 in such a way that the wider diameter end 38 of the spring 36 receives the guide unit 20 of the tray 13, and the wider diameter end 38 abuts the lower surface 17 of the tray 13, supporting the tray. As shown in FIG. 6, when a tray 13 is loaded with articles 9, the spring 36 compresses, allowing the tray 13 to rest on the articles 9 directly below it. The winding of the spring 36 is such that the spring 36 remains compressed until the tray 13 has been emptied, at which time the spring 36 extends, automatically raising the empty tray 13 so that articles stored directly beneath the empty tray 13 may be accessed. As shown in FIG. 6, each tray 13 on the center pole 10, excluding the tray 13 resting on the upper surface 51 of the base 11, may be fitted with a spring 36.

As shown in FIGS. 7–9, another preferred embodiment of the present invention includes a plurality of spacer poles 39 to support and separate the trays 13 on the center pole 10. The spacer poles 39 are identical, and are preferably hollow, constructed of rigid paper tubes. Each spacer pole 39 includes a pair of telescoping tubes forming a wide diameter end 40 and a narrow diameter end 41. Preferably, the narrow diameter end 41 includes a reinforcing dowel 42, as shown in FIGS. 7*a* and 8, which gives added stability to the spacer pole 39. The reinforcing dowel 42 is preferably constructed of wood.

The spacer poles 39 are used by first inserting the narrow diameter end of a spacer pole 39 into each of a plurality of peripheral base holes 45 bored into the periphery of base 11, as shown in FIG. 2 and FIG. 7. The wider diameter end 40 of spacer pole 39 has a lower supporting surface 44, as shown in FIG. 7*a*, which rests on the upper surface 51 of base 11. Alternatively, a tray 13 may be placed on base 11, in which case the lower supporting surface 44 of spacer pole 39 rests on the article supporting surface 14 as shown in FIG. 7. As shown in FIGS. 7 and 7*a*, peripheral tray holes 50 in the lowermost tray 13 are aligned with the peripheral base holes 45 in the base 11 and the narrow diameter end 41 of the spacer pole 39 is inserted through the peripheral tray hole 50 and the vertical base hole 45 of the base 11. After a spacer pole 39 is inserted in all of the peripheral base holes 45 in the base 11, a tray 13 is placed on top of the spacer poles 39 by sliding the tray 13 down the center pole 10 and resting the tray 13 on the upper supporting surface 43 on each spacer pole 39. The outside diameter of the wide diameter end 40 of the spacer poles 39 is greater than the diameter of the peripheral tray holes and peripheral base holes. The wide diameter end 40 of the spacer poles 39 thus allows the upper supporting surface 43 of the spacer poles 39 to support the tray 13 positioned above the spacer holes 39, while the lower supporting surface 44 allows the spacer poles 39 to rest on the tray below. The inside diameter of the wide diameter end 40 of spacer poles 39 is sized to snuggly receive the narrow diameter end 41 of another spacer pole 39 as shown in FIG. 8. The peripheral tray holes 50 of the tray 13 are aligned with holes 48 in the spacer poles 39, as shown in FIGS. 7 and 7*a*. Once the tray 13 is so aligned, additional trays may be added to the system by inserting the narrow diameter end 41 of a spacer pole 39 through each of the peripheral tray holes 50 in tray 13, and into the hole 48 in the spacer pole 39 below. This procedure may be followed until the desired number of trays have been added to the system.

A plurality of plugs 46 is preferably used to secure the uppermost tray 13 to the spacer poles 39 supporting it, as shown in FIGS. 7 and 9. In use, each plug 46 is inserted through a peripheral tray hole 50 in the tray 13 into the hole 48 in the spacer pole 39, securing the uppermost tray 13 to the spacer poles 39. As shown in FIG. 9, the plugs 46 include a threaded portion 47 which permits the plugs to frictionally engage with the inner wall 52 in the spacer poles 39. The plugs 46 also include a cap 49 which allows the plugs to be gripped for insertion and removal, and which secures the tray 13 to the spacer pole 39. The plugs 46 are preferably constructed of a light, durable material such as molded plastic.

An advantage of this embodiment is that the rigid tube-in-tube construction of the spacer poles 39 and the use of plugs 46 allows all the spacer poles to be identically constructed and permits the user to quickly assemble and disassemble the unit using no tools. The spacer poles 39 also can be constructed of varying heights to accommocate various heights of articles on different trays.

It should be understood that various changes and modifications to the preferred embodiments described herein will be apparent to those skilled in the art. Such changes and modifications can be made without departing from the spirit and scope of the present invention and without diminishing its attendant advantages. It it intended that the foregoing description be regarded as illustrative rather than limiting, and that it be understood that it is the following claims, including all equivalents, which are intended to define the scope of this invention.

We claim:

1. A vertical display system comprising:

a center pole;

means for supporting said center pole in an upright position;

one or more trays having an article supporting surface and a center opening through which said center pole may be slidably received;

tray storing means positioned near the top of said center pole and protruding from said center pole;

each tray further having guide means bordering said tray center opening, and configured to permit said tray to slide along said center pole and over and above said tray storing means; and each said tray also having holding means adjacent said tray center opening, and configured to allow said tray to be supported by said tray storing means.

2. The vertical display system of claim 1 further comprising a header having support means to be secured to an upper end of said center pole, and a surface for bearing printed matter.

3. A vertical display system comprising:

a center pole;

a base for supporting said center pole in an upright position;

one or more trays having an article supporting surface and a center opening through which said tray may be slidably received by said center pole;

tray storing means positioned near the top of said center pole, said tray storing means including a plurality of protruding members;

each said tray further having guide means bordering said tray center opening, and configured to permit said tray to slide along said center pole, said guide means including a plurality of vertical grooves shaped such that said tray may be slid past said protruding members when said vertical grooves are aligned with said protruding members; and each said tray also having holding means adjacent said tray center opening, said tray holding means including a plurality of notches shaped to rest on said protruding members, such that said protruding members support and hold said tray near the top of said center pole.

4. The vertical display system of claim 3 wherein said center pole includes an upper and lower section, said upper section having a tapered end which is slidably received by an opening in one end of said lower section.

5. The vertical display system of claim 3 wherein said base includes an upper surface for supporting a said tray, and an opening for slidably receiving said center pole.

6. The vertical display system of claim 3 wherein the tray storing means includes two or more horizontally disposed pins, protruding outwardly from said center pole.

7. The vertical display system of claim 3 further including header means adapted to be secured to the upper end of said center pole and including surfaces adapted to carry product identification labels.

8. The vertical display system of claim 3 wherein each said tray further includes a retaining wall around the periphery of said article supporting surface, said retaining wall further including a skirt portion.

9. The vertical display system of claim 3 wherein each said tray is identical, and is shaped to permit said trays to be stacked one on top of the other for storage.

10. The vertical display system of claim 1 wherein each said tray further includes a retaining wall around the periphery of said article supporting surface, each said tray further including a lower surface adapted to permit each said tray to rest on said center pole supporting means, said lower surface further adapted to permit each said tray to rest on articles being displayed immediately below each said tray.

11. The vertical display system of claim 5 wherein said base includse an opening for slidably receiving said center pole, further including a reinforcing disc journaled within said base, said reinforcing disc having a hole positioned coaxially and coextensively with said opening in said base.

12. A vertical display system comprising:

a center pole;

a base for supporting said center pole in an upright position, said base having an opening therethrough for slidably receiving said center pole;

an array of trays, each said tray having an upper article supporting surface and a center opening through which said tray may be slidably received by said center pole, each said tray having a lower surface adapted to permit each said tray to rest on said base, and further adapted to permit each said tray to rest on articles being displayed below each said tray;

tray storing means positioned near the top of said center pole, said tray storing means including two or more scews inserted horizontally in said center pole, and equally spaced around said center pole, the heads of said screws projecting from said center pole;

each said tray including a guide sleeve bordering said center opening in each said tray;

said guide sleeve including a plurality of vertical grooves, equal in number to said screws, said vertical grooves equally spaced around said guide sleeve, said vertical grooves shaped to enable said tray to be slid along said center pole past said screws when said vertical grooves are aligned with said screws;

tray holding means positioned on the lower surface of each said tray, said tray holding means including a plurality of notches equal in number to said screws, said notches equally spaced between said vertical grooves in said guide sleeve, said notches shaped to rest on said screws when said tray is slid upwardly on said center pole past said screws and rotated to align said notches with said screws and said tray is lowered on said center pole to rest on said screws.

13. The vertical display system of claim 12 further comprising a header having a pair of header wires and a header panel for bearing printed matter, said header wires having a looped portion shaped to be received by an opening at the upper end of said center pole, said header wires further including hooked portions for supporting said header panel.

14. The vertical display system of claim 12 wherein said base further includes a reinforcing disc, said reinforcing disc being journaled within said base, said reinforcing disc including a hole positioned coaxially and coextensively with the opening in said base for accepting said center pole.

15. The vertical display system of claim 12 wherein said base further includes a larger diameter opening for receiving said guide means of one said tray when said tray is positioned on said base.

16. The vertical display system of claim 12 wherein each said tray includes a retaining wall around the periphery of said upper article supporting surface, said retaining wall further including a skirt portion which extends below said lower surface, said lower surface and said skirt portion further adapted to permit said trays to be stacked when said trays are empty.

* * * * *